US005116295A

United States Patent [19]

Dunn et al.

[11] Patent Number: 5,116,295

[45] Date of Patent: May 26, 1992

[54] WATER IMMERSED STAIR CLIMBER WITH AIR BLADDER

[76] Inventors: Thomas J. Dunn, 7963 Glen Abby Cir., Orlando, Fla. 32819; Donald B. Gronachan, 4 Spiral Rd., Holtsville, N.Y. 11742

[21] Appl. No.: 781,850

[22] Filed: Oct. 24, 1991

Related U.S. Application Data

[63] Continuation-in-part of Ser. No. 638,237, Jan. 7, 1991, Pat. No. 5,060,935.

[51] Int. Cl.[5] ..... A63B 21/20; A63B 23/04

[52] U.S. Cl. ..... 482/53; 482/111

[58] Field of Search ..... 272/69, 70, 71, 72, 272/73, 130, 96, 1 B

[56] References Cited

U.S. PATENT DOCUMENTS 4,204,675 5/1980 McGinnis ..... 272/96
4,645,197 2/1987 McFee ..... 272/130
5,060,935 10/1991 Dunn et al. ..... 272/130

FOREIGN PATENT DOCUMENTS 2243794 9/1972 Fed. Rep. of Germany ..... 272/70

*Primary Examiner*—Stephen R. Crow
*Attorney, Agent, or Firm*—Galgano & Belkin

[57] ABSTRACT

Stair climbing exercising apparatus for use under water comprising a pair of laterally adjacent stepping levers pivotally mounted at one end, the excerciser stepping on the other end, and resistance to downward motion being imposed by the buoyancy of bladders attached to said stepping levers.

12 Claims, 2 Drawing Sheets

FIG. 5
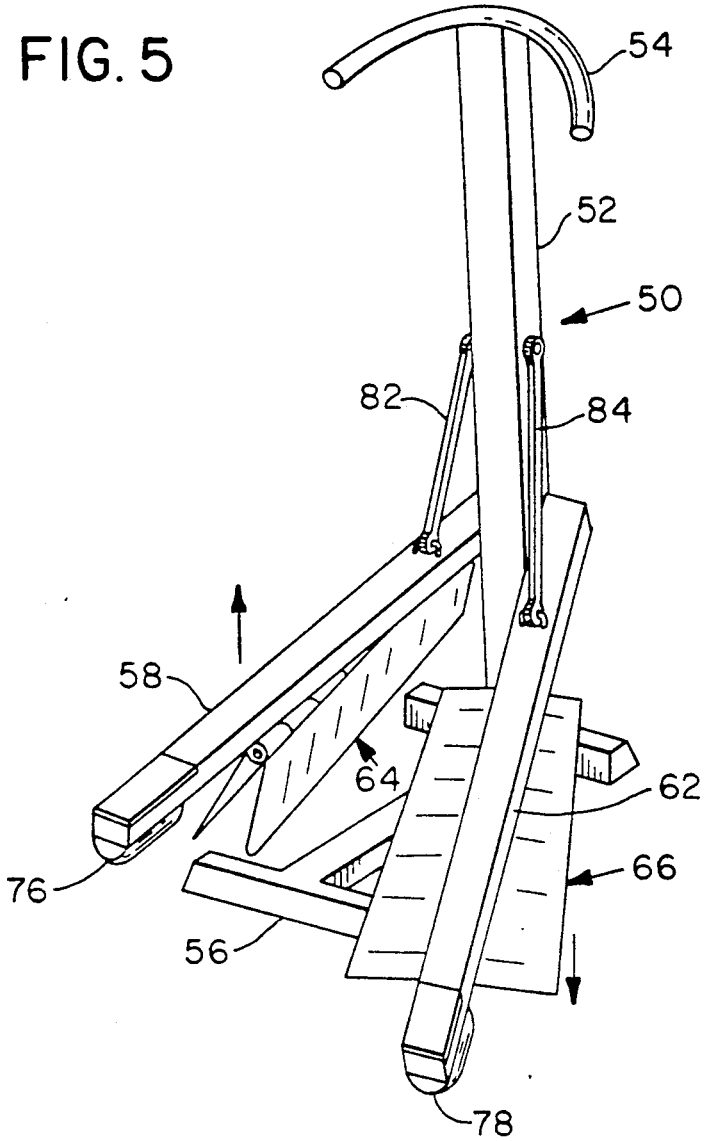
FIG. 6
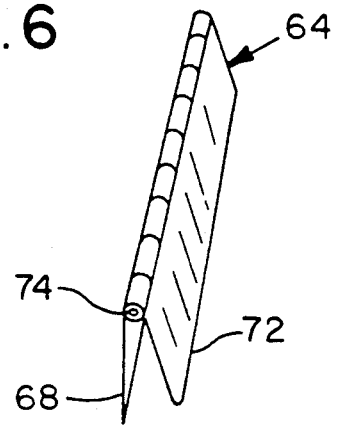
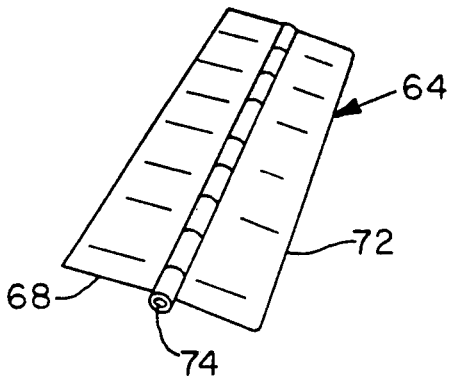
FIG. 7

WATER IMMERSED STAIR CLIMBER WITH AIR BLADDER

This application is a continuation-in-part of our patent application Ser. No. 07/638,237 filed on Jan. 7, 1991 now U.S. Pat. No. 5,060,935 for "Water Immersed Stair Climber".

BACKGROUND OF THE INVENTION

Our earlier application relates to stair climber exercise apparatus for use under water.

One of the disadvantages of the previous invention is the inability of the user to conveniently and quickly change the underwater resistance himself while using the apparatus.

SUMMARY OF THE INVENTION

This invention is an improvement over my earlier invention by providing means for the user while operating the equipment to conveniently and quickly adjust the resistance.

In the present invention this is accomplished by providing one or more adjustably buoyant devices such as air bladders on the stepping levers with one or more hand pumps located on the handle bars for inflating the bladders. The exerciser while on the stair climber and even while exercising can adjust the amount of air in the bladders and thereby control the buoyancy of each bladder and the amount of resistance being introduced.

It is thus a principal object of this invention to provide controllable buoyancy to the stepping levers of immersed stair climber exercise apparatus.

Other objects and advantages of this invention will hereinafter become obvious from the following description of the preferred embodiments of this invention.

BRIEF DESCRIPTION OF THE FIGURES

FIG. 5 is a perspective view of an alternative embodiment of this invention.

FIG. 6 is a perspective view of the wing-like device in a closed position.

FIG. 7 is a perspective view of the wing-like device in an open position.

DESCRIPTION OF THE PREFERRED EMBODIMENTS

Figure 2:
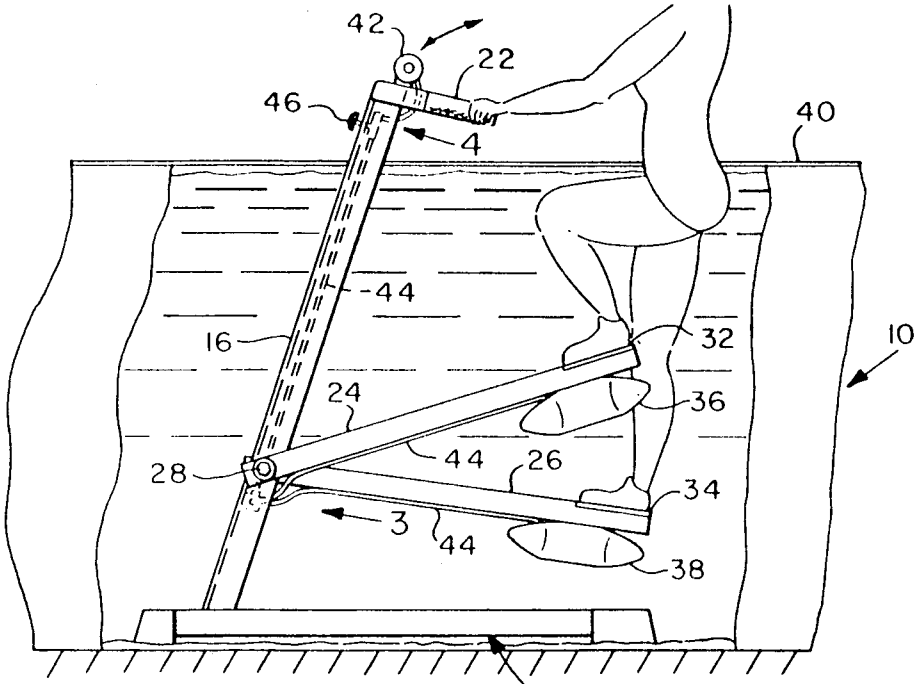
FIG. 2 is a right side view of the embodiment shown in FIG. 1 mounted for use in a pool of water.
Figure 4:
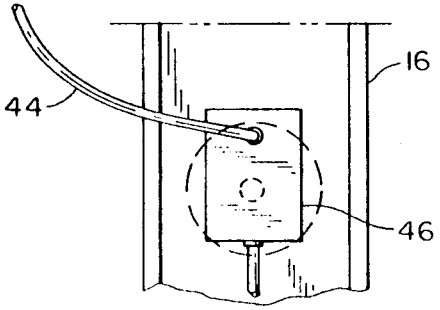
FIG. 4 is a view taken in the direction of 4 in FIG. 2.
Figure 1:
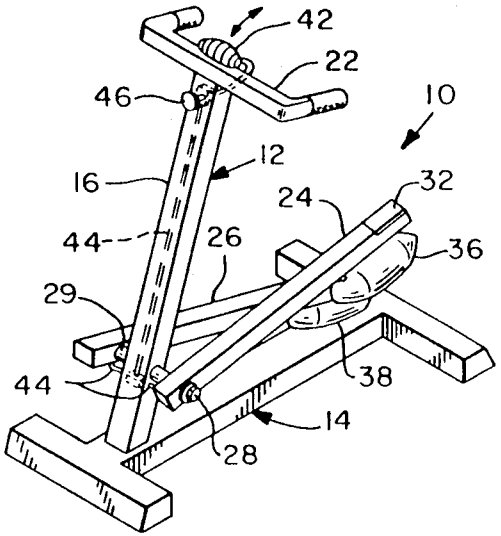
FIG. 1 is a perspective view of a preferred embodiment of this invention.

Referring to FIGS. 1-4, stair climber 10 consists of a stationary frame 12 comprising an H-shaped horizontally extending platform 14 supporting an upwardly extending member 16. A handgrip or handlebar 22 is attached to the top of member 16.

Mounted pivotally on member 16 are a pair of left and right stepping levers 24 and 26. Shafts 28 and 29 passing through member 16 and stepping levers 26 and 28 provide this pivoting action at the distal ends thereof.

The proximal ends of stepping levers 24 and 26 are provided with foot pads 32 and 34, respectively, and bladders 36 and 38 are located under and attached to levers 24 and 26, respectively, as illustrated.

As is understood in the art, bladders 36 and 38 are made of a suitable inflatable and stretchable material such as rubber so that they may be expanded or deflated over a wide range depending upon the amount and pressure of air or other gas within said bladders. Bladders 36 and 38 are adjustably buoyant devices.

As seen in FIG. 2, stair climber 10 is typically immersed in a pool 40 of water.

To introduce adjustable resistance to the movement of stepping levers 24 and 26, inflation of bladders 36 and 38, and hence their buoyancy, is made adjustable in the manner to now be described.

Figure 3:
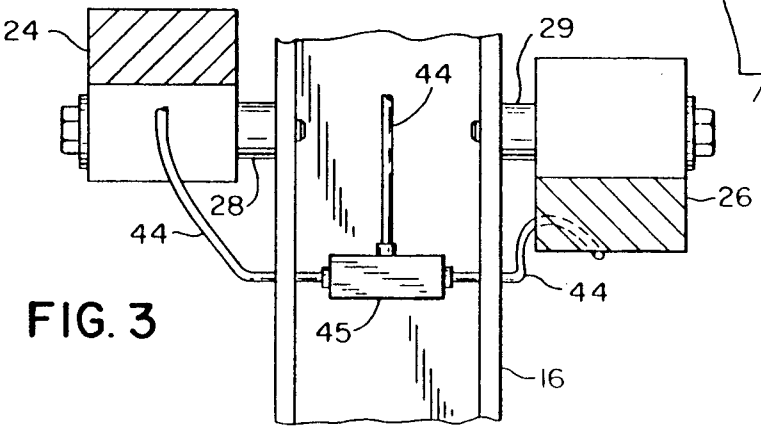
FIG. 3 is a section view taken in the direction of 3 in FIG. 2.

Mounted on top of handlebar 22 is a hand pump 42 with an air lock valve as is understood in the art and which is connected by hoses or tubes 44 to bladders 36 and 38. Hand pump 42 is a conventional squeeze type bulb for compressing air which is fed through tubes 44 to bladders 36 and 38. As seen in FIG. 3, member 16 may be hollow or V-shaped in which hoses or tubes 44 may extend, a Tee 45 being utilized to split said hoses or tubes.

Tubing 44 may be provided with a valve 46 to bleed out air when it is desired to deflate or reduce the buoyancy of bladders 36 and 38.

It is understood that bladders 36 and 38 may be provided with separate hand pumps and tubes if desired so that buoyancy in each can be controlled separately. It will also be noted from the figures that stepping levers 24 and 26 are not linked together by a cable as in my earlier patent application. In this way, the exerciser using stair climber 10 has more flexibility in the manner he uses the apparatus. By way of example, in a rehabilitation or medical situation, a user, due to an injury, may not be capable of equal work on the right and left pedals. On the other hand, stepping levers 24 and 26 may be linked together, if desired.

In the use of stair climber 10, the buoyancy of bladders 36 and 38 provides resistance which the exerciser must overcome. The exerciser himself or herself can while on the apparatus change the amount of buoyancy and thus the resistance being encountered by further inflating the bladders by repeatedly squeezing hand pump 42 to pump air into the bladders or releasing some air from the bladders using bleed valve 46.

Another embodiment of this invention is shown in FIGS. 5-7.

Stair climber 50 similar in construction to stair climber 10 is provided with an upright member 52, handlebars 54 and 62 are pivoted at one end on upright member 52 in a manner similar to stepping levers 24 and 26 previously described.

Mounted under each stepping lever 58 and 62 are identical wing-like structures 64 and 66, respectively. As also seen in FIGS. 6 and 7, wing like structure 64 consists of a pair of flaps 68 and 72 hinged on a shaft 74 which is attached to the underside of stepping lever 58. When the latter is moving upwardly as shown by the arrow in FIG. 5, structure 64 will fold as seen in FIGS. 5 and 6, thereby reducing resistance in the water to the upward motion. When the lever is moving down, as is lever 62 in FIG. 5, then structure 66 will be forced open by the water resistance, as shown also for structure 64 in FIG. 7, thereby providing additional resistance to the downward motion.

Upward or returning force on stepping levers 58 and 62 may be provided by air bladders 76 and 78 mounted on under these levers as illustrated or by the use of elastic members 82 and 84 connected between upright member and each of the stepping levers, 58 and 62, respectively, or both in combination with each other, as shown. Elastic members 82 and 84 can be made of elastic material or be springs.

By varying the amount of opening permitted in structures 64 and 66 it is possible to control the amount of resistance. Also, instead of bladders 76 and 78, buoyancy can be provided by suitable buoyant material such as styrofoam members, the addition and removal of blocks of this material being employed to vary the buoyancy. This can also be done using weights strung over pulleys.

It is thus seen that there has been provided unique stair climbing apparatus for use under water which permits the user to adjust the resistance while using the apparatus.

While only certain preferred embodiments of this invention have been described, it is understood that many variations may be possible without departing from the principles of this invention as defined in the claims which follow.

What is claimed is:

1. Stair climbing apparatus for use by an exerciser comprising:

a. support frame means including a ground engaging base immersed in water;

b. a pair of laterally adjacent foot stepping means pivotally mounted on said support frame means at a location above said base; and c. resistance means mounted on and connected solely to said stepping means for relying on said water to resist downward pivotal movement of said stepping means said apparatus being sufficiently immersed so that the water level is above said resistance means, said resistance means including means for establishing adjustable buoyancy which resists downward motion of said stepping means.

2. The stair climbing apparatus of claim 1 in which said stepping means are extended with said exerciser standing on the proximate ends of said stepping means, said stepping means being pivoted at the distal ends thereof, and said resistance means being attached to the undersides of said stepping means.

3. The stair climbing apparatus of claim 2 in which said buoyancy establishing means comprises an inflatable bladder attached to each of said stepping means and means for inflating said bladders.

4. The stair climbing apparatus of claim 3 in which said buoyancy establishing means includes means actuated by said exerciser to change said buoyancy while exercising on said apparatus.

5. The stair climbing apparatus of claim 4 in which the actuated means comprises a hand operated pump for said exerciser to pump air into said bladders.

6. The stair climbing apparatus of claim 5 in which said actuated means also includes means for releasing air from said bladders to reduce buoyancy.

7. The stair climbing apparatus of claim 6 in which said bladders are located under the proximal ends of said stepping means.

8. The method of exercising comprising the steps of:

a. immersing stair climbing apparatus in water, said stair climbing apparatus comprising support frame means including a ground engaging base, a pair of laterally adjacent foot stepping levers pivotally mounted on said support frame means at a location above said base, said stepping levers being extended with said levers being pivoted at the distal ends thereof, and resistance means mounted on and connected solely to the said stepping levers for relying on said water to resist pivotal movement of said stepping levers, said apparatus being immersed sufficiently to cover said resistance means said resistance means including means for establishing adjustable buoyancy which resists downward motion of said stepping levers; and b. stepping on the proximal ends of said levers to produce reciprocal motion of said levers with resistance to downward motion by said buoyancy being introduced by said resistance means.

9. The method of claim 8 in which the amount of buoyancy is adjustable by said exerciser.

10. Stair climbing apparatus for use by an exerciser comprising:

a. support frame means including a ground engaging base immersed in water;

b. a pair of laterally adjacent foot stepping levers pivotally mounted on said support frame means at a location above said base;

c. resistance means mounted on said stepping levers for relying on said water to resist downward pivotal movement of said stepping levers said apparatus being sufficiently immersed so that the water level is above said resistance means, said resistance means including wing-like openings when said levers are moving downwardly to increase resistance, and closing when said levers are moving upwardly to collapse and decrease water resistance; and d. buoyance means for providing an upward return force for each lever.

11. The stair climbing apparatus of claim 10 where said return force means comprises a buoyant member.

12. The stair climbing apparatus of claim 10 where said return force means comprises elastic members which are stretched when a lever is moved downwardly.

* * * * *